United States Patent [19]

Perry

[11] 4,173,336

[45] Nov. 6, 1979

[54] STRIKING EQUIPMENT FOR DEVELOPING MARTIAL ART SKILLS

[76] Inventor: Robert W. Perry, 21 Patricia Dr., Tyngsboro, Mass. 01879

[21] Appl. No.: 852,820

[22] Filed: Nov. 18, 1977

[51] Int. Cl.[2] ..... A63B 69/00

[52] U.S. Cl. ..... 272/76; 248/309 A

[58] Field of Search ..... 272/76, 77, 78, 65, 272/66

[56] References Cited

U.S. PATENT DOCUMENTS

| | | | |
|---|---|---|---|
| 694,335 | 2/1902 | Thenan et al. | 272/76 |
| 1,509,750 | 9/1924 | Campbell | 272/134 |
| 2,812,180 | 11/1957 | Cymbal | 272/66 |
| 3,427,021 | 2/1969 | Donato | 272/76 |

FOREIGN PATENT DOCUMENTS

| | | | |
|---|---|---|---|
| 1526964 | 4/1968 | France | 272/76 |

OTHER PUBLICATIONS

"Power Fist" Board Holder, Black Belt Magazine, Jan. 1976, p. 18.

*Primary Examiner*—Richard C. Pinkham
*Assistant Examiner*—Arnold W. Kramer
*Attorney, Agent, or Firm*—Herbert L. Gatewood

[57] ABSTRACT

The invention involves a striking board for use in developing one's skill in the martial arts and comprises in its basic aspects in superimposed relation, a relatively flexible cushion member for striking with one's hand, supported by a relatively inflexible member, which in turn is supported by a relatively inflexible spacing member and a further relatively inflexible member, the latter member being of such a construction that the striking board can be held by hand or supported by a bracket support on a wall or other support surface. The bracket support supports the striking board of the invention by compression springs so as to offer suitable resistance to a striking blow. The striking board can be removed from the bracket support, if desired, and hand held by a training partner. The striking board is covered with leather or leather-like plastic coated fabric so as to present a pleasing appearance to the striking board, and less abrasiveness to one's hand in use.

17 Claims, 4 Drawing Figures

STRIKING EQUIPMENT FOR DEVELOPING MARTIAL ART SKILLS

BACKGROUND OF THE INVENTION

1. Field of the Invention

This invention relates to sporting equipment, in particular to a striking board used in developing skill in the material arts and its manner of manufacture, and to a bracket support means for detachably mounting and supporting the striking board on a vertical wall or the like.

2. Description of the Prior Art

Although unarmed self-defense developed in the Orient over a period of thousands of Years, only in relatively recent years has the martial arts become popular in the United States, and throughout the rest of the Western World.

One particular species of the martial arts, "karate", a Japanese word meaning "empty hand", has developed in a wide variety of styles. Nevertheless, those styles practiced in Japan, Korea, and Okinawa are by far the most prevalent styles practiced in the Western World.

The art of karate was practically unknown in the United States until after the second World War. And significant growth of this activity in this country did not really occur until the Korean War. During and after this conflict many American soldiers were exposed to karate while stationed in Japan and Korea. Some even joined training schools and became rather proficient.

Karate's popularity in the United States has been furthered by the many public appearances by karate experts on television, in demonstrations, and tournaments, as well as through numerous books and magazines, now commonly available.

After becoming somewhat proficient at delivering a variety of karate techniques, the karateka practices against a target that provides some resistance upon contact. Besides the strength-building benefits, the resistance offers better preparation in terms of sport usage, or in an occasion whereby self-defense becomes desirable. If a karateka is not accustomed to the feeling of forceful contact, the effectiveness of his or her blocks and blows will be considerably reduced.

As a karateka cannot use human beings as targets for powerful techniques unless protective clothing is worn, it is simpler and safer to practice against inanimate objects, a variety of which have been suggested for use.

One inanimate object used by a karateka is commonly known as a makiwara. This is an upright post with a padded target area for striking. These devices are available commercially and some books on karate give instructions on making such a striking device. A seven-foot length of 2"×4" lumber can be used for the post, although a 4"×4" is preferred. The striking target can be made of an eight-inch length of sponge rubber covered with, and attached to the post by, canvas. The thickness of the sponge rubber target can be varied, depending upon an individual's preferences; however, a thickness of two to four inches is generally satisfactory. If more dense foam rubber is used, a one-inch striking pad may even be suitable for some.

The post is sunk far enough into the ground that the midpoint of the striking pad is at the level of one's solar plexus. Where a 4"×4" post is used, it must be beveled so that the thickness is about one-half-inch at the top and about three inches at the ground level. This gives the post the necessary flexibility or "give". Concrete blocks are generally provided as bracing members and are placed on opposite side of the post below ground level.

A portable makiwara has also been suggested for use by a karateka. In the construction of such a device a post is braced at the sides and rear of the striking surface by metal bracing to a support, which rests on and may be moveable over a floor surface. This model can also have an additional striking pad for kicking, if desired.

A training bag traditionally used by boxers, i.e., a heavy cylindrical-shaped bag that is attached to a ceiling, is also often used by a karateka. Certain such devices have been constructed specifically for karate use and are now available commercially. The training bag can be used without assitance; however, often a training partner holds the bag so as to increase resistance offered by the bag when struck a blow.

Other devices used by a karateka for training include a football blocking dummy, the pushback dummy, and a punching mitt.

While all of the devices now commercially available of which applicant is aware offer certain advantages in training, their use is also attendant with certain disadvantages. The traditional makiwara is a stationary target, and though portable models can be also constructed, it still is a somewhat cumbersome striking target to use. This sort of striking device moreover can only be used alone by a karateka. Blocking dummies and punching mitts can be used on the other hand only with a training partner.

SUMMARY OF INVENTION

The invention disclosed and claimed herein comprises in its basic aspects a striking board which can be used by one developing his skills in the martial arts, either, alone or with a training partner. The invention comprises in one aspect a striking board per se and in a further aspect a striking board in combination with bracket support means which, not only supports striking board for use without a training partner, but also provides, in addition to the fastening function, a "give" to the striking board when hit a blow.

The striking board of the invention comprises, in its basic aspects, a relatively flexible cushion member for striking supported by a relatively inflexible top board which in turn is fixedly connected to and is supported by a relatively more inflexible baseboard. A spacing member is provided between the top and baseboard which is in contact with each and transmits the force of a blow to the cushioned top board to the baseboard. This is desirable to prevent breakage of the top board.

As the striking board of the invention is provided with means for holding it in one's hands, it offers a distinct advantage over the traditional makiwara in that a training partner can be used in practicing striking exercises. Its portability further offers complete freedom and flexibility not only for class striking exercises anywhere, but for individual practice.

A bracket support means is also provided in accordance with a further aspect of my invention which makes it possible to mount the striking board on a vertical surface such as a wall or the like so that the striking board can be, if desired, used without a partner. The bracket support means comprises means such as compression springs which provide not only resistance to the striking board when struck a blow, but some desirable "give".

The striking board of the invention, and the bracket combination offers not only convenience in use of the board by oneself, or with a training partner, but provides excellent conditioning of a karatekas' hands and wrists for jabs, back fist, ridge hands, reverse punches and many more.

My striking board develops not only focus, timing and hitting accuracy, but also efficiency in developing breaking techniques.

Quite advantageously, the simplicity in construction and size of the striking board of the invention offers convenience in use and portability not found with the traditional makiwara, yet development of the same martial art skills.

BRIEF DESCRIPTION OF THE DRAWING

The above and other objects and advantages of the invention will best be understood in the following detailed description of a preferred embodiment thereof, taken in connection with the appended drawings in which.

DETAILED DESCRIPTION OF THE INVENTION AND PREFERRED EMBODIMENT

Figure 1:
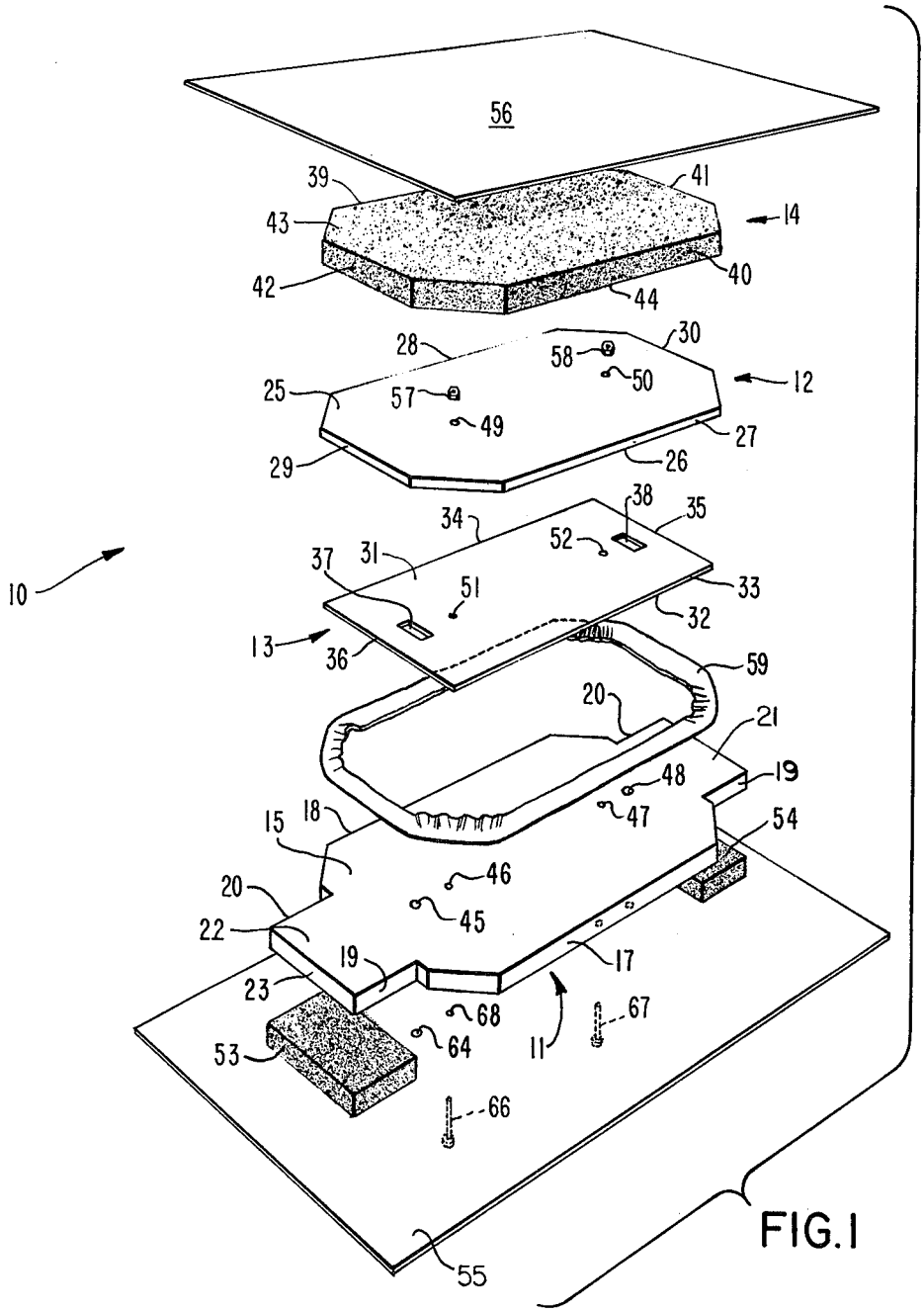
FIG. 1 is an exploded view in perspective of a striking board in accordance with the invention.
Figure 2:
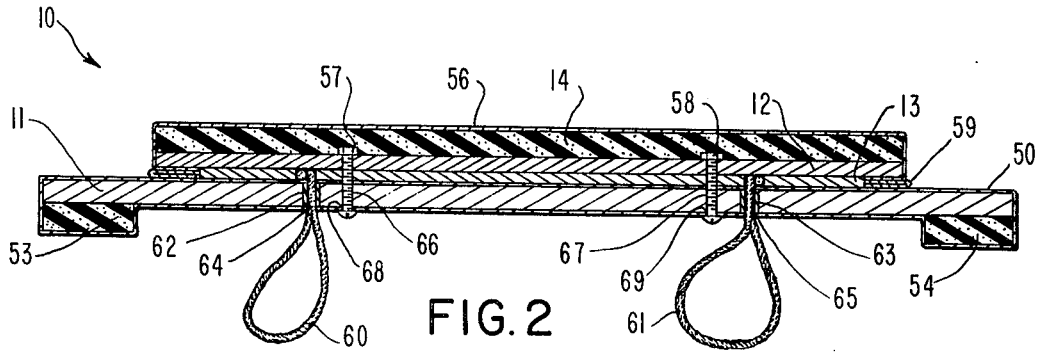
FIG. 2 is a cross-sectional view of the striking board showing how its various components are joined together.

Turning now to the drawing there is shown therein in FIG. 1. a striking board 10 in accordance with the invention comprising a baseboard 11, a top board 12, a spacing member 13, intermediate the baseboard and the top board, and a cushion member 14.

Baseboard 11, as shown in the drawing, is of a somewhat rectangular shape having planar top and bottom surfaces 15, 16 parallel to one another, a first pair of parallel side edges 17, 18, defining a first width, a second pair of side edges 19, 20 defining a lesser second width, and end portions 21, 22. The end portions are defined by parallel end edges 23, 24 and are integregal with and provide means not only for a training partner to hold the wider striking surface, but also a means for mounting the striking board to a support surface, as hereinafter later described.

The baseboard can be of various relatively inflexible materials provided suitable stiffness and strength against impact breakage is provided. This may vary somewhat, of course, on the user. I have found these requirements to be suitably met in a plywood commercially available under the trade designation "Russian Plywood". The plywood used in the practice of my invention comprises eleven lamina bonded together and is $\frac{5}{8}$ inch in thickness. However, suitable performance will in general be provided where the plywood comprises as few as eight lamina bonded together.

Top board 12 is also of a somewhat rectangular shape having planar top and bottom surfaces 25, 26 parallel to one another, side edges 27, 28, and end eges 29, 30. The width of top board 12 is such as to be coextensive with the width of baseboard 11 defined by parallel side edges 17, 18. Its length is not coextensive with the length of baseboard 11 and is defined by the lack of end portions 21, 22 of the baseboard.

Top board 12 can be of various materials of construction provided the material is somewhat inflexible. Plywood can be used, however, I have found that one-fourth inch fibre board gives satisfactory performance. When greater strength is desirable, a conventional plywood lamina of a suitable thickness to obtain the desired strength can be used.

Spacing member 13 is of rectangular shape and is defined by planar top and bottom surfaces 31, 32, parallel side edges 33, 34 and parallel end edges 35, 36. Openings 37, 38, which extend through spacing member 13, are provided for a purpose to be described later on. Spacing member 13 being in contact overall with top board 12 and baseboard 11 transmits the force of a blow from cushioned top board member 12 to baseboard 11. Thus, a top board 12 of somewhat lesser resistance to flexing can be used than where a spacing member is not provided. The spacing member can be of various materials of construction; however, a plywood lamina five-thirty-seconds inch thick has been found suitable.

Cushion member 14 is of a matching shape to, and is laterally and longitudinally coextensive with, top board 12, being defined by parallel side edges 39, 40, and parallel end edges 41, 42, and having top and bottom planar surfaces 43, 44. The cushion member can be of various relatively flexible materials, e.g., foam rubber, sponge, and synthetic cellular materials such as of polyurthane and polyvinyl chloride foams. A flexible material that has been found satisfactory in the practice of the invention comprises particles of cellular material compressed together and is available from Lorum Fibre & Foam Corporation.

Cellular material of various density and thickness can be used, depending upon the amount of cushioning desired. However, I have found that if a cellular cushion material such as is available from Lorum Fibre & Foam Corporation is used, a one inch thick layer provides satisfactory performance.

As shown in the drawing, in FIG. 1., the corners of the striking surface of baseboard 11, and the corners of top board 12, and cushion member 14 are cut off. This not only provides a striking surface of somewhat better aesthetics but also provides a striking surface configuration that is more uniformly resistant to breakage. Sharp corners tend to break easier on being dealt a heavy blow and are also somewhat less desirable from a safety viewpoint.

In the manufacture of a striking board 10 in accordance with the invention, a baseboard 11, is cut from a suitable larger piece of Russian Plywood five-eighths inch thickness to provide a board having an overall length of sixteen inches and a striking area width of six inches. The corners are cut at a forty-five degree angle so as to provide end portions 21, 22 for holding, measuring three and three-eighths inches across, and a striking area length of twelve inches. Circular openings 45, 46 and 47, 48 are provided in baseboard 11 for a purpose to be described later. These are located on the longitudinal center line of baseboard 11.

Next, cushion member 14 and top board 12 are cut from suitable source material, these to be of a complementary configuration to the striking surface defined by the baseboard. Spacing member 13 is then cut to a dimension of five inches by ten inches.

Circular openings 49, 50 and 51, 52 are provided in top board 12, and spacing member 13, respectively, these matching up in location with openings 46, 47 in baseboard 11, so that in assembly baseboard 11, top board 12 and spacing member 13 are coextensive in the striking area.

Palm cushions 53, 54 are cut from a suitably dense foam such as above described, measuring the dimension of the end portions 21, 22 of baseboard 11 and are adhesively secured to the respective bottom surface of the baseboard.

A base cover 55 and top cover 56 are then cut from suitable cover material such as plastic coated knit fabric, polyvinyl chloride, or canvas for covering the baseboard, top board and cushion member. The top cover should measure ten by twenty-seven inches, to provide suitable overlap, as hereinafter described. The base cover 55 is placed over the bottom surface 16 of baseboard 11, the ends and edges thereof overlapping the side and end edges 17, 18, and 23, 24, and these being made secure, or fastened down on top surface 15. This can be done with staples, in accordance with the practice of the invention, but other means can be used, for example, tacks or adhesive. The overlap onto top surface 15 should be about one-fourth to one-half inch and the base cover should be tight and free of wrinkles.

Cushion member 14 is then placed on top surface 25 of top board 12, to which nuts 57, 58 have been previously adhesively secured concentric with circular opening 49, 50, top cover 56 then being used to cover top surface 43 of cushion member 14. The edges and ends of top cover 56 overlap the ends and side edges of cushion member 14 and top board 12 and are secured to the bottom surface 26 of top board 12 by staples, these being located about one-half inch inwardly from the edge, all around the perimeter of the top board.

A strip of material one inch wide is then cut from the same material as the base and top cover, or from another source, if desired. This material is to be used to form seam 59, this being accomplished by folding the strip cut, in half, the fold forming the outer perimeter of the seam. The strip cut should be of sufficient length so that the folded ends can be placed together so the seam will appear continuous around the perimeter of the striking surface, as seem in FIG. 3. of the drawing.

Two lengths (18 inches long) of rope are then cut from a one-fourth inch diameter nylon rope or the like for use as wrist ropes 60, 61. Each length of rope is folded in half and a piece of plastic tubing 62, 63 is placed over the ends joining them together, the tubing being located near the ends of the rope but leaving about one-half inch of each end exposed. These ends are then feathered for a purpose made obvious hereinafter.

The ends of wrist ropes 60, 61 are then inserted through circular opening 45, 48 in baseboard 11 via circular opening 64, 65, respectively, made in base cover 55. Plastic sleeves 62, 63 are just of sufficient length to extend from just below the bottom surface 16 of baseboard 11 to the upper surface 15 thereof thereby exposing the feathered ends of the rope in openings 37, 38 in spacing member 13, the bottom surface 32 of which has been previously adhesively secured to top surface 15 of baseboard 11. Adhesive is provided over the entire top surface 31 of spacing member 13 and on the feathered ends of the wrist ropes. This secures the wrist rope and prevents their being pulled loose from the striking board. The ends can also be tacked down if desired to make them even more secure.

In use, a training partner puts his hands through the loops of the wrist ropes and then takes the end portion of the striking board in his hands. The ropes provide added protection in the event a blow causes him to lose hold of the board.

Threaded screws 66, 67 are then inserted through circular openings 46, 47 in baseboard 11, circular openings 68, 69 in base cover 55 having been previously provided for this purpose, and top cover cushioned top board 12, assembled with spacing member 13 and baseboard 11. Prior to assembly seam 59 is stapled in location around the edge of bottom surface 26 of the top board.

When the assembly is made, screws 66, 67 are joined with nuts 57, 58, respectively. Adhesive provided on the upper surface of spacing member 13, along with screws 66, 67 and nuts 57, 58 provide a unitary combination. As the planar surfaces are all parallel to one another, and adjacent surfaces are in contact, the force of a blow to the cushion member 14 is transmitted to baseboard 11.

The use of spacing member 13 provides not only for transmission of the force of a blow to the baseboard 11 but permits use of seam 59 which provides for a more decorative appearance. Without spacing member 13, however, the thickness of seam 59 in combination with the overlap thickness makes for a space between top board 12 and baseboard 11. As these two members are joined together by screws 66, 67, any space between these two members results in the force of any blow being taken substantially by the top board. This results in breakage of the top board unless a board considerably more inflexible is used. However this is undesirable as it means using a board of greater thickness. Omission of seam 59 is undesirable as it makes for a less desirable appearance and, moreover, does not entirely eliminate the problem. Even without seam 59, a space, though it is somewhat less, between the two members still exists due to the thickness of the base and top cover material.

While the means for fastening the assembly of the top board spacing member, and baseboard shown are screw members and nuts, as well as adhesive, it will be appreciated that dowels can be used instead.

Figure 4:
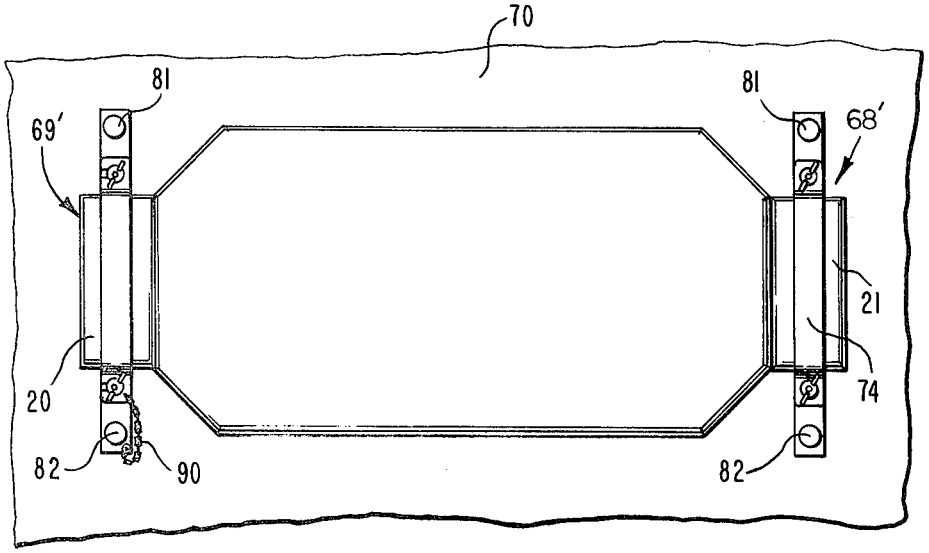
FIG. 4 is a view showing the striking board of the invention in combination with the bracket support means, showing the striking board fastened to a vertical wall surface.

In accordance with a further aspect of the invention, there is provided, as is shown in FIG. 4. of the drawing, a bracket support means comprising bracket means 68' and 69' for mounting striking board 10, and supporting it, on a vertical surface such as a wall 70. These brackets are essentially of the same construction except that one can be, if desired, constructed such that it provides easier and faster removal of striking board 10 from the bracket support means.

Figure 3:
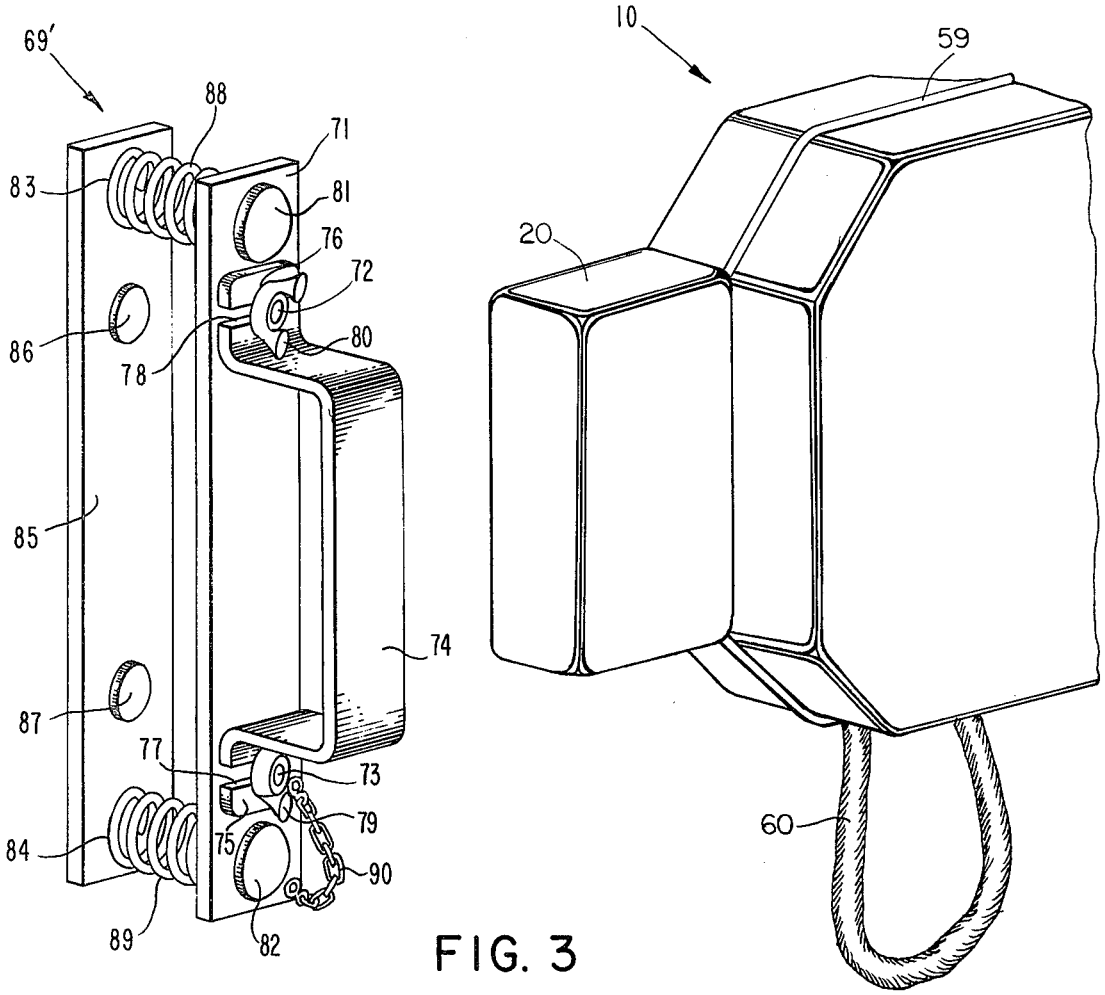
FIG. 3 is a perspective view of one bracket of the bracket support means according to the invention and a portion of the end of the striking board to be supported by it.

As shown more clearly in FIG. 3. of the drawing, bracket means 69' comprises a striking board support plate 71 of generally rectangular configuration and having planar upper and lower surfaces in which are provided two circular openings (not shown) for entry of wing nut screws 72, 73. These openings are desirably threaded; however, need not be. Associated therewith is a hold down bracket 74 of generally U-shaped configuration in cross-section and of uniform thickness having feet 75, 76 bearing against support plate 71. In these feet are provided edge slots 77, 78, respectively, which engage with wing nut screws 72, 73, and permit ready and easy removal of hold down bracket 74 from engagement with wing nut screws 72, 73, without removal of wing nuts 79, 80.

Adjacent the ends of support plate 71 are provided circular shaped openings (not shown) in which are located bolts 81, 82 which terminate in, and are in threaded connection with circular shaped threaded openings 83, 84, respectively in bottom support plate 85. The bottom support plate 85 is of rectangular configuration having planar top and bottom surfaces and is provided intermediate the ends thereof with circular shaped openings 86, 87, by means of which the bracket can be mounted by screw means, not shown, to a vertical support such as a wall or post.

Top support plate 71 is free to move on bolts 81, 82 toward bottom support plate 85. This movement is resisted, however, by coil compression springs 88, 89, surrounding bolts 81, 82. These coil springs can be of any strength desired, however, coil springs offering 105 lbs./in.$^2$ compression will be found generally satisfactory. The springs can be of spring steel or piano wire and are commercially available. Springs found suitable have a five-eights inch O.D. and are one and one-fourth inches in length. Recesses can be provided in the surfaces of supports 71, 85 contacted by the ends of the coil springs to keep them in proper alignment.

The length of bolts 81, 82 should be chosen so that when threaded into threaded opening 83, 84, the ends thereof are flush with the bottom surface of support plate 85. There should be no slack between these two support members and, if desired, the springs can be just very slightly compressed.

Hold down bracket 74 can be provided with chain 90 one end of which is attached to the hold down bracket and the other end of which is attached to top support plate 71. Thus, when hold down bracket 74 is disengaged from wing nuts 72, 73, it will be readily available for reengagement.

Bracket means 68' is similar in construction to that of bracket means 69' except for the hold down bracket. Instead of slots being provided in the feet of the hold down bracket, circular openings are provided. And the hold down bracket and top support plate always remain in operative association with one another.

In the practice of the invention the support plates and hold down brackets have been manufactured from one-fourth inch and one-eighth inch thick aluminum 6063, respectively, however, other materials can be used if desired. The bracket members need not be metal, and can be molded from various plastic materials. The dimensions of the bracket members can be varied; however, rectangular support plates one by seven and three-fourths inches will be found satisfactory. The hold down bracket should conform to the shape of the end portions 20, 21 of baseboard 11 to provide good support.

As will be appreciated in looking at FIG. 3. of the drawing, and by analogy to wing nuts 79, 80, the wing nuts for bracket means 68 need be loosened only slightly to allow the distance between the hold down bracket and the top support bracket to be enlarged or lessened to allow removal of, or insertion of, end 21 into the bracket opening. Hold down bracket 74 is, of course, disengaged from the wing nuts to allow removal of striking board 10 from bracket means 69'.

In use, when mounted on a wall, a striking blow to the cushioned member results in "giving" resistance, and limited rebound by the striking board. The amount of resistance is determined by the compression strength of the four springs, all of which should be of equal compressive strength. The rebound is, of course, limited to the length of the bolts fastening the two support members together and the length of the spring.

As many different embodiments of this invention will have now occurred to those skilled in the art, it is to be understood that the specific embodiments of the invention as presented herein are intended by way of illustration only and are not limiting on the invention, but that the limitations thereon can be determined only from the appended claims.

What I claim is:

1. A striking board for use in developing one's skill in the martial arts comprising in assembly a relatively inflexible baseboard having planar top and bottom surfaces parallel to one another, a striking surface defined by a first pair of parallel side edges defining a first width of the baseboard, and a second pair of parallel side edges defining a lesser second width of the baseboard, said first pair of parallel said edges being parallel with said second pair of parallel side edges, first and second end portions integral with and extending in opposite directions from said striking surface of said baseboard defined by the said second pair of parallel side edges and defining parallel end edges, a relatively inflexible top board having planar top and bottom surfaces parallel to one another, said top board defined by parallel side edges and having a width coextensive with that of the striking surface of the said baseboard and by parallel end edges defining a lesser length non-coextensive to the length of said baseboard but coextensive with the striking surface, a rectangular shaped spacing member intermediate said top board and baseboard having parallel planar top and bottom surfaces and parallel side edges and end edges defining a lesser width and length than said top board, a relatively flexible cushion member having parallel planar top and bottom surfaces, and being of a width and length so as to be coextensive laterally and longitudinally with said top board and said striking surface, and the bottom planar surface of said cushion member being supported by the top planar surface of said top board, a base cover extending over the bottom surface of the baseboard and being secured by means on the top surface thereof, a top cover extending over the top surface of the said flexible cushion member and being secured by means to the bottom surface of the top board, a seam comprising a material folded in half secured to said bottom surface of the top board around and along its perimeter, and means securing said baseboard, spacing member and top board in assembly together, said seam in the assembly being located around the perimeter of the rectangular spacing member.

2. A striking board according to claim 1 wherein relatively flexible pads are provided on the bottom surface of the end portions for cushioning the blow to a training partner's hands holding the board.

3. A striking board according to claim 1 wherein loops of rope are provided connected to the striking board for aid to a training partner in holding the striking board during use.

4. A striking board according to claim 1 wherein the baseboard comprises five-eighths inch Russian Plywood.

5. A striking board according to claim 1 wherein the top board comprises one-fourth inch compressed hard board.

6. A striking board according to claim 1 wherein the spacing member comprises five-thirty seconds inch plywood.

7. A striking board according to claim 1 wherein the base and top cover comprises a plastic coated fabric substance.

8. A striking board according to claim 1 wherein the means securing said baseboard, spacing member, and top board together in assembly are screw means.

9. A striking board according to claim 1 wherein the cushion member comprises a cellular plastic material.

10. Bracket means for supporting and mounting a striking board according to claim 1 comprising a first and second bracket means for supporting the striking board by said end portions of the baseboard, each said bracket means comprising a top support plate for supporting the bottom surface of an associated baseboard end portion, means in combination with said top support plate and said end portion for holding the end portion of the baseboard in contact with said support plate, a bottom support plate for mounting said bracket means to a wall or the like, means for maintaining said top support plate and said bottom support plate in predetermined spaced apart parallel distance from one another while allowing movement of said top support plate toward said bottom support plate, and means opposing movement of said top and bottom support plates toward one another.

11. Bracket means for supporting and mounting a striking board in accordance with claim 10 wherein said means for holding an end portion in contact with the top support plate is a hold down bracket having a shape conforming to the cross-section of the end portion, said hold down bracket being fastened by means to said support plate.

12. Bracket means for supporting and mounting a striking board according to claim 11 wherein said fastening means provides detachable connection between the hold down bracket and the top support plate.

13. Bracket means for supporting and mounting a striking board according to claim 12 wherein the fastening means are wing nuts.

14. Bracket means for supporting and mounting a striking board according to claim 13 wherein open slots are provided in at least one of said hold down brackets for providing easy removal from engagement of the hold down bracket with the wing nuts.

15. Bracket means for supporting and mounting a striking board according to claim 10 wherein said means for maintaining the said top and bottom support plates in predetermined spaced apart parallel distance from one another comprises bolts threaded in said bottom support plate and said bolts pass through openings in said top support plate whereby said top support plates are free to move along the length of said bolts toward and away from said bottom support plate.

16. Bracket means for supporting and mounting a striking board according to claim 15 wherein said means opposing movement of said top and bottom support plates toward one another comprises coiled compression springs surrounding said bolts.

17. Bracket means for supporting and mounting a striking board according to claim 16 wherein said coil compression springs each offer 105 lbs/in$^2$ compression.

* * * * *